US009080767B1

(12) United States Patent
Garlington

(10) Patent No.: US 9,080,767 B1
(45) Date of Patent: Jul. 14, 2015

(54) WICK TRIMMER

(76) Inventor: Mitchell Garlington, Baton Rouge, LA (US)

( * ) Notice: Subject to any disclaimer, the term of this patent is extended or adjusted under 35 U.S.C. 154(b) by 443 days.

(21) Appl. No.: 13/490,916

(22) Filed: Jun. 7, 2012

(51) Int. Cl.
*F23D 3/16* (2006.01)
*F23D 3/36* (2006.01)
*B26B 13/06* (2006.01)

(52) U.S. Cl.
CPC .. *F23D 3/36* (2013.01); *B26B 13/06* (2013.01)

(58) Field of Classification Search
CPC ..... F23D 3/36; B26B 13/00; B26B 13/06; B26B 17/00; B26B 27/00
USPC ..... 431/120, 253; 30/278–285
See application file for complete search history.

(56) References Cited

U.S. PATENT DOCUMENTS

| | | | | |
|---|---|---|---|---|
| 920,822 | A | 5/1909 | Buckman | |
| 2,932,224 | A * | 4/1960 | Peed, Jr. et al. | 30/91.2 |
| 5,023,997 | A | 6/1991 | Salvi | |
| 6,243,954 | B1 | 6/2001 | Bowers | |
| 6,321,453 | B1 | 11/2001 | Pappas | |
| 6,405,441 | B1 | 6/2002 | Rucker | |
| 6,813,832 | B2 | 11/2004 | Alexander | |
| D505,607 | S | 5/2005 | McMinn | |
| D593,825 | S | 6/2009 | Huie | |
| 2003/0172533 | A1 | 9/2003 | Alexander | |
| 2004/0166452 | A1 | 8/2004 | McInnis | |
| 2005/0227191 | A1 | 10/2005 | Feaser | |

* cited by examiner

*Primary Examiner* — Alfred Basichas
(74) *Attorney, Agent, or Firm* — R. Keith Harrison

(57) ABSTRACT

A wick trimmer includes a pair of connected first and second trimmer arms; a first wick trimmer jaw carried by the first trimmer arm; a second wick trimmer jaw carried by the second trimmer arm, the first and second wick trimmer jaws selectively positional between an open position and a closed, wick cutting position; a first wick cutting blade having a first blade notch carried by the first wick trimmer jaw; and a second wick cutting blade having a second blade notch carried by the second wick trimmer jaw, the second blade notch generally symmetrical to the first blade notch and disposed in generally facing and offset relationship to the first blade notch in the open position of the first and second wick trimmer jaws. The second blade notch bypasses the first blade notch as the first wick trimmer jaw and the second wick trimmer jaw move from the open position to the closed, wick cutting position.

20 Claims, 3 Drawing Sheets

WICK TRIMMER

FIELD

Illustrative embodiments of the disclosure generally relate to wick trimmers for candles. More particularly, illustrative embodiments of the disclosure relate to a wick trimmer which can be used to trim a candle wick and retain the severed wick until subsequent disposal.

BACKGROUND

In the use of candles, it is often necessary or desirable to periodically cut or trim the wick of a candle in order to maintain the wick at a desired or optimum length for relighting of the candle. Maintaining the wick at an optimum length may prevent the candle from being consumed too rapidly and may also prevent or minimize the formation of unconsumed wax surrounding the wick as the wick burns down through the wax of the candle. Therefore, various cutting devices such as scissors have been used to trim candle wicks. However, conventional cutting devices may have various drawbacks which render their use for trimming candle wicks undesirable. For example, many cutting devices which are commonly used to trim candle wicks may require that a user physically touch the wick as it is cut and/or as the severed wick is carried to a trash receptacle to be discarded. However, smut from the wick may contaminate the hands or fingers as the wick is removed from the candle and carried. Moreover, touching the wick may be particularly undesirable if the wick is severed after use of the candle, when the wick may still be hot to the touch.

Accordingly, a wick trimmer which can be used to trim a candle wick and retain the severed wick until subsequent disposal may be desirable for some applications.

SUMMARY

Illustrative embodiments of the disclosure are generally directed to a wick trimmer which can be used to trim a candle wick and retain the severed wick until subsequent disposal. An illustrative embodiment of the wick trimmer includes a pair of connected first and second trimmer arms; a first wick trimmer jaw carried by the first trimmer arm; a second wick trimmer jaw carried by the second trimmer arm, the first and second wick trimmer jaws selectively positional between an open position and a closed, wick cutting position; a first wick cutting blade having a first blade notch carried by the first wick trimmer jaw; and a second wick cutting blade having a second blade notch carried by the second wick trimmer jaw, the second blade notch generally symmetrical to the first blade notch and disposed in generally facing and offset relationship to the first blade notch in the open position of the first and second wick trimmer jaws. The second blade notch bypasses the first blade notch as the first wick trimmer jaw and the second wick trimmer jaw move from the open position to the closed, wick cutting position.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. As used herein, relative terms such as "upper", "lower", "front" and "back" are used to describe exemplary positions of various components relative to each other in exemplary use of the wick trimmer to cut or trim a candle wick and are not intended to be construed in a limiting sense.

Figure 9:
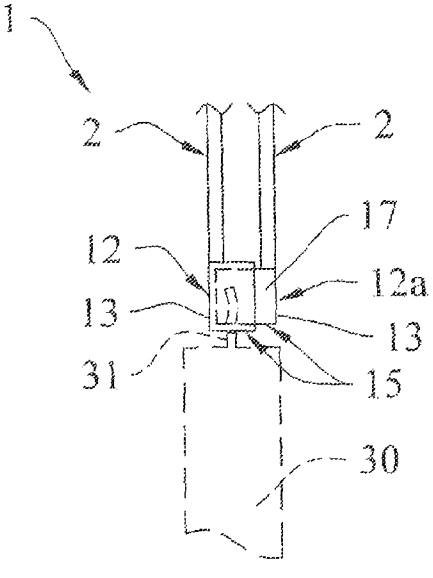
FIG. 9 is a side view of a candle (illustrated in phantom and partially in section), with the wick cutting blades moving beyond each other as the candle wick is severed.
Figure 10:
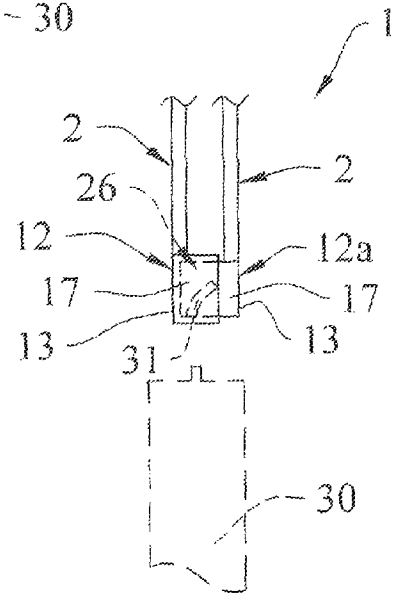
FIG. 10 is a side view of a candle (illustrated in phantom and partially in section) after the candle wick is severed, with the severed candle wick retained in a wick containment enclosure formed by the wick trimmer jaws.

Referring to the drawings, an illustrative embodiment of the wick trimmer is generally indicated by reference numeral 1. As illustrated in FIGS. 7-10 and will be hereinafter further described, in exemplary application, the wick trimmer 1 can be used to cut or trim a candle wick 31 (illustrated in phantom) on a candle 30. As illustrated in FIG. 10, after it is cut, the severed wick 31 can be retained in the wick trimmer 1 until the severed wick 31 is discarded. While the wick trimmer 1 will be described herein with respect to trimming of a candle wick 31, it will be recognized and understood that the design of the wick trimmer 1 may inherently render the wick trimmer 1 amenable to a variety of other uses.

Figure 2:
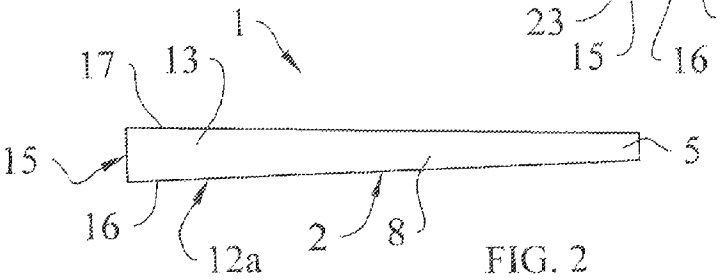
FIG. 2 is a side view of an illustrative embodiment of the wick trimmer.
Figure 3:
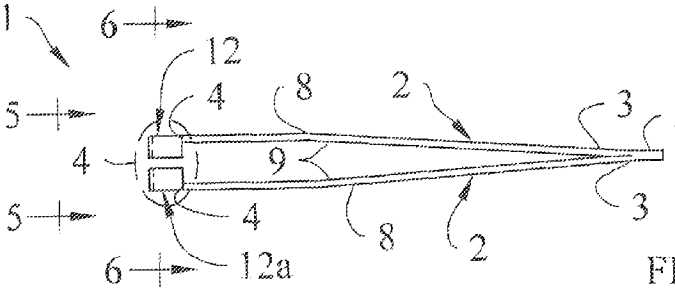
FIG. 3 is a top view of an illustrative embodiment of the wick trimmer.

The wick trimmer 1 includes a pair of generally elongated trimmer arms 2. Each trimmer arm 2 may have a proximal arm end 3 and a distal arm end 4. In some embodiments, each trimmer arm 2 may be substantially straight throughout its length in side view (FIG. 2). The proximal arm ends 3 of the trimmer arms 2 may be flexibly joined together at an arm connecting portion 5. As used herein, the term "proximal" means closer to the arm connecting portion 5 whereas the term "distal" means further away from the arm connection portion 5. As illustrated in FIG. 3, the trimmer arms 2 may flex in a diverging, spreading, arcing or curving configuration outwardly away from each other from the proximal arm ends 3 to the distal arm ends 4. Accordingly, the distal arm ends 4 may normally be disposed in spaced-apart relationship to each other. The trimmer arms 2 can be selectively squeezed together to bend or deform the distal arm ends 4 toward each other at the arm connection portion 5, for purposes which will be hereinafter described. Each trimmer arm 2 may have a generally rectangular cross-section with an outer arm surface 8 and an inner arm surface 9 which faces the inner arm surface 9 of the opposite trimmer arm 2.

A pair of wick trimmer jaws 12, 12*a* terminates the distal arm ends 4 of the respective trimmer arms 2. Each wick trimmer jaw 12, 12*a* may have a jaw interior 20 which faces the jaw interior 20 of the other wick trimmer jaw 12, 12*a*. The jaw interior 20 of the wick trimmer jaw 12 may have a volume which is larger than the size of the wick trimmer jaw 12*a* and therefore, is sized to contain or accommodate the wick trimmer jaw 12*a* in a closed, wick cutting position of the wick trimmer 1, as illustrated in FIG. 6A and will be hereinafter described.

Figure 1:
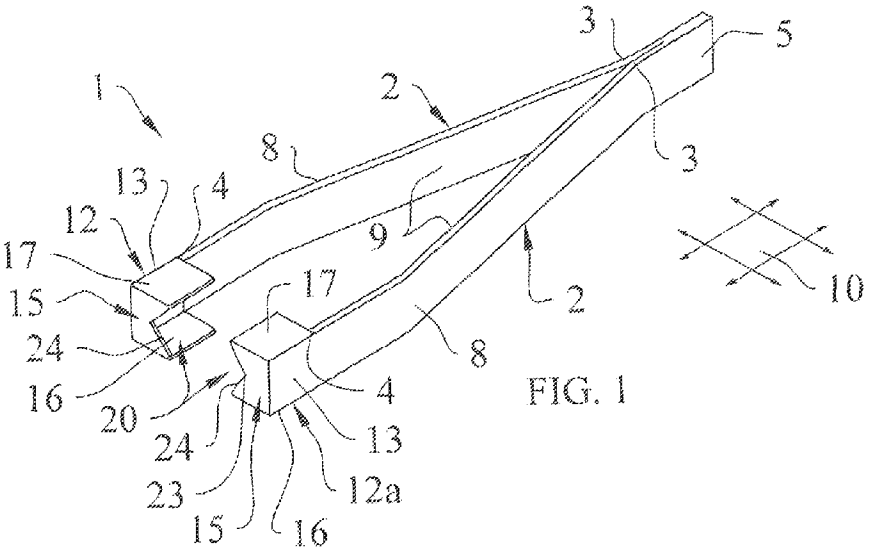
FIG. 1 is a perspective view of an illustrative embodiment of the wick trimmer.

A wick cutting blade 15 is provided on each wick trimmer jaw 12, 12*a*. In some embodiments, the wick cutting blade 15 may be generally flat or planar. The wick cutting blade 15 may close the distal end of the jaw interior 20, as illustrated in FIG. 1. As illustrated in FIGS. 5 and 6B, a blade notch 22 which may be generally V-shaped may be provided in an edge of each wick cutting blade 15. Each blade notch 22 may have a pair of sloped blade edges 24, 25 and a wick groove 23 at the junction of the blade edges 24, 25. As further illustrated in FIG. 5, the blade notches 22 in the wick cutting blades 15 of the respective wick trimmer jaws 12, 12*a* may be generally symmetrical and are disposed in generally facing and offset relationship to each other.

Figures 4, 5, 6, 6A, 6B, 6C, 7:
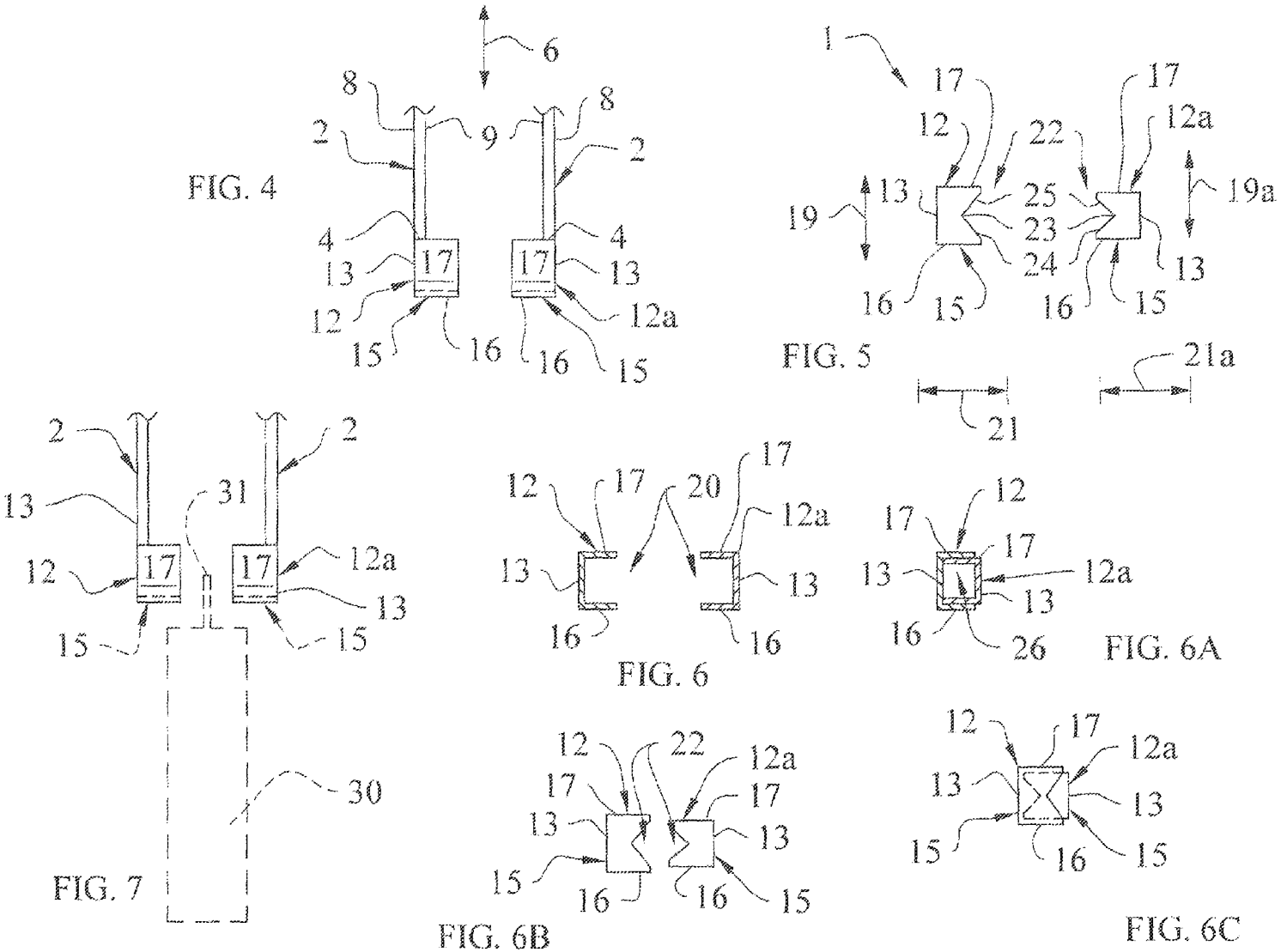
FIG. 4 is an enlarged top sectional view, taken along section line 4 in FIG. 3, of a pair of wick trimmer jaws provided on a pair of trimmer arms, respectively, of the wick trimmer.
FIG. 5 is an end view, taken along viewing lines 5-5 in FIG. 3, of the wick trimmer jaws disposed in spaced-apart relationship to each other.
FIG. 6 is a cross-sectional view, taken along section lines 6-6 in FIG. 3, with the trimmer jaws of the wick trimmer disposed in spaced-apart relationship to each other.
FIG. 6A is a cross-sectional view, taken along section lines 6-6 in FIG. 3, with the wick trimmer jaws disposed in a nesting configuration in a wick-cutting position of the wick trimmer jaws.
FIG. 6B is an end view, taken along viewing lines 5-5 in FIG. 3, of the wick trimmer jaws approaching each other in application of the wick trimmer.
FIG. 6C is an end view, taken along viewing lines 5-5 in FIG. 3, of the wick trimmer jaws disposed in a nesting configuration in a wick-cutting position of the wick trimmer jaws and wick cutting blades.
FIG. 7 is a side view of a candle (illustrated in phantom), with the wick trimmer (partially in section) oriented in a generally vertical position and the candle wick inserted between the wick trimmer jaws preparatory to cutting the candle wick.

The trimmer jaws 12, 12*a* are selectively positional between an open position (FIGS. 5 and 6) and a closed, wick cutting position (FIGS. 6A and 6C). The flexibility of the trimmer arms 2 may normally bias the trimmer jaws 12, 12*a* in the open position. As illustrated in FIG. 6A, upon application of inward pressure to the trimmer arms 2, the jaw interior 20 of the trimmer jaw 12 receives and contains or accommodates the trimmer jaw 12*a* in the wick cutting position. As illustrated in FIG. 6C, the wick cutting blade 15 of the trimmer jaw 12*a* inserts into the jaw interior 20 of the trimmer jaw 12 and overlaps the wick cutting blade 15 of the trimmer jaw 12 as the wick grooves 23 in the wick cutting blades 15 of the respective trimmer jaws 12, 12*a* bypass or move beyond each other in opposite directions. This bypass movement of the wick grooves 23 in the wick cutting blades 15 facilitates trimming, cutting or severing of the candle wick 31 (FIGS. 7-10) as will be hereinafter further described. In the wick cutting position of the trimmer jaws 12 and 12*a*, the jaw notches 20 of the respective trimmer jaws 12, 12*a* combine to form a wick containment enclosure 26 (FIG. 6A).

In some embodiments, each trimmer jaw 12, 12*a* may have a generally C-shaped cross-section, as illustrated in FIG. 6. Accordingly, each trimmer jaw 12, 12*a* may have a pair of generally rectangular, planar, parallel, spaced-apart side jaw panels 16 and 17. A generally rectangular outer jaw panel 13 may extend between the side jaw panels 16, 17. The outer jaw panel 13 may be disposed in generally perpendicular relationship to the wick cutting blade 15 and each of the side jaw panels 16.17. The outer jaw panel 13 may be generally flat or planar and may be continuous and coplanar with the outer jaw surface 8 of the corresponding trimmer arm 2. The side jaw panels 16, 17 may be continuous and coplanar with the lower and upper surfaces or edges, respectively, of each corresponding trimmer arm 2.

As illustrated in FIG. 4, in some embodiments, each trimmer jaw 12, 12*a* may be elongated along a longitudinal axis 6 of the trimmer arms 2. Accordingly, each of the outer jaw panel 13 and the side jaw panels 16, 17 of each trimmer jaw 12, 12*a* may have a generally elongated, rectangular shape. As illustrated in FIG. 1, in some embodiments, the trimmer arms 2 and the trimmer jaws 12.12*a* may be disposed within a common plane 10. As illustrated in FIG. 5, the wick trimmer jaw 12 may have a jaw width 19 and a jaw depth 21 which are greater than a jaw width 19*a* and a jaw depth 21*a*, respectively, of the wick trimmer jaw 12*a*. Therefore, the jaw interior 20 of the wick trimmer jaw 12 is sized to accommodate or contain the wick trimmer jaw 12*a* in the wick cutting configuration of the wick trimmer 1, as was noted herein above.

In the various embodiments, the wick trimmer 1 may be fabricated of a metal such as stainless steel, aluminum, brass or bronze, for example and without limitation. Alternatively, the wick trimmer 1 may be fabricated of an alternative flexible and durable material such as a composite material, for example and without limitation. The wick trimmer 1 may be fabricated using any of a variety of fabrication techniques known by those skilled in the art. For example and without limitation, the trimmer arms 2 and the trimmer jaws 12.12*a* of the wick trimmer 1 may be fabricated in one piece using conventional casting or molding techniques known by those skilled in the art. Alternatively, the trimmer arms 2 may be fabricated using a combination of casting or molding techniques and the trimmer jaws 12, 12*a* may be formed using casting or molding or a combination of casting or molding and machining techniques. The trimmer arms 2 and the trimmer jaws 12.12*a* may be fabricated separately and then the trimmer jaws 12, 12*a* attached to the trimmer arms 2 using welding, mechanical fasteners and/or other suitable attachment technique known by those skilled in the art.

Referring next to FIGS. 7-10 of the drawings, in exemplary application, the wick trimmer 1 is used to cut or trim a candle wick 31 of a candle 30 (illustrated in phantom) typically after use of the candle 30. Periodic trimming of the candle wick 31 may be necessary or desirable to maintain the candle wick 31 at a desired length for relighting of the candle 30 and optimum burning and consumption of the candle 30. In some applications, the candle 30 may be contained in a jar (not illustrated) or other enclosure. Accordingly, a user (not illustrated) grips the trimmer arms 2. The flexible trimmer arms 2 are normally biased outwardly in the separated configuration illustrated in FIGS. 1 and 3. As illustrated in FIG. 7, the trimmer jaws 2 are held in a generally vertical orientation and the spaced-apart trimmer jaws 12 are positioned on opposite sides of the candle wick 31 such that the blade notches 22 in the wick cutting blades 15 on the respective wick trimmer jaws 12, 12*a* face the base portion of the candle wick 31 typically at a point above where the candle wick 31 emerges from the upper end of the candle 30 and where the candle wick 31 is to be trimmed.

Figure 11:
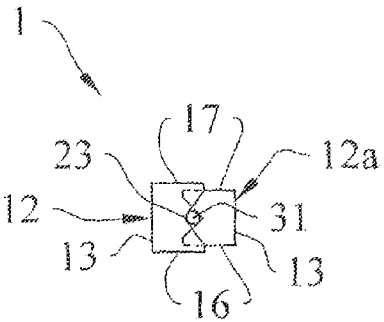
FIG. 11 is a bottom view of the wick trimmer jaws, with the candle wick positioned between the wick cutting blades as the wick cutting blades cut the candle wick.
Figure 8:
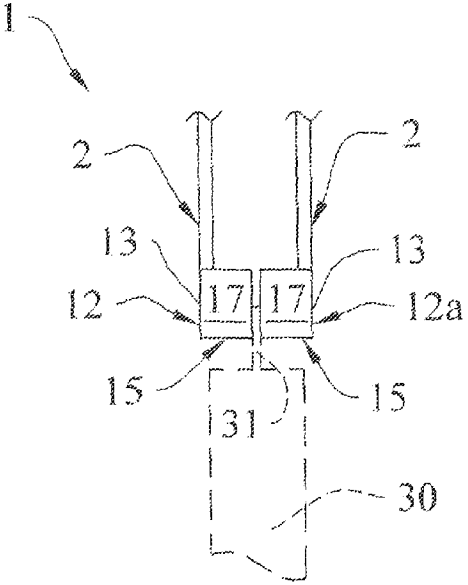
FIG. 8 is a side view of a candle (illustrated in phantom and partially in section), with the wick cutting blades of the wick trimmer (partially in section) engaging opposite sides of the candle wick preparatory to cutting the candle wick.

Next, the user squeezes the trimmer arms 2 inwardly toward each other such that the wick trimmer jaws 12, 12*a* approach each other, as illustrated in FIG. 8. The jaw interior 20 of the wick trimmer jaw 12 receives and accommodates the wick trimmer jaw 12*a*, as illustrated in FIG. 9. Simultaneously, as illustrated in FIG. 11, the wick grooves 23 in the blade notches 22 of the respective wick cutting blades 15, aided by the complementary angled blade edges 24, 25 (FIG. 5) in the blade notches 22 on the respective wick cutting blade 15*s*, receive the candle wick 31. Continued squeezing of the trimmer arms 2 toward each other causes the wick cutting blades 15 to move beyond or bypass each other until the candle wick 31 is severed and the side jaw panels 16.17 of the wick trimmer jaw 12*a* typically engage and are stopped by the interior surface of the outer jaw panel 13 of the wick trimmer jaw 12. As illustrated in FIG. 6A, when the wick trimmer jaw 12*a* is nested in the jaw interior 20 of the wick trimmer jaw 12, the jaw interiors 20 together form a wick containment enclosure 26 which contains the severed candle wick 31, as further illustrated in FIG. 10.

It will be appreciated by those skilled in the art that the severed candle wick 31 rests on the wick cutting blade 15 of the wick trimmer jaw 12*a* in the wick containment enclosure 26, and the wick cutting blade 15 prevents the severed candle wick 31 from falling out of the wick containment enclosure 26. While the trimmer jaws 12 remain closed typically by continued application of squeezing pressure to the trimmer arms 2, the severed candle wick 31 can be carried to a suitable waste container (not illustrated) or other suitable disposal location for disposal of the severed candle wick 31. The severed candle wick 31 can be selectively removed from the wick containment enclosure 26 typically by releasing the trimmer arms 2 such that the trimmer jaws 12 separate and the severed candle wick 31 falls into the waste container.

While the embodiments of the disclosure have been described above, it will be recognized and understood that various modifications can be made and the appended claims are intended to cover all such modifications which may fall within the spirit and scope of the disclosure.

What is claimed is:

1. A wick trimmer, comprising:

a pair of connected first and second trimmer arms;

a first wick trimmer jaw carried by the first trimmer arm;

a second wick trimmer jaw carried by the second trimmer arm, the first and second wick trimmer jaws selectively positional between an open position and a closed, wick cutting position;

a first wick cutting blade having a first blade notch carried by the first wick trimmer jaw and a first wick groove in a center of the first blade notch;

a second wick cutting blade having a second blade notch carried by the second wick trimmer jaw and a second wick groove in a center of the second blade notch, the second blade notch generally symmetrical to the first blade notch and the second wick groove in the second blade notch disposed in generally facing and offset relationship to the first wick groove in the first blade notch in the open position of the first and second wick trimmer jaws;

the second wick groove in the second blade notch bypasses the first wick groove in the first blade notch as the first wick trimmer jaw and the second wick trimmer jaw move from the open position to the closed, wick cutting position; and each of the first wick trimmer jaw and the second wick trimmer jaw includes a pair of generally rectangular, planar, parallel, spaced-apart side jaw panels and a generally rectangular outer jaw panel extending between the side jaw panels, the outer jaw panel disposed in generally perpendicular relationship to the wick cutting blade and each of the side jaw panels; and the second wick trimmer jaw substantially contained within the first jaw interior of the first wick trimmer jaw and the side jaw panels of the second wick trimmer jaw engage the outer jaw panel of the first wick trimmer jaw in the closed, wick cutting position.

2. The wick trimmer of claim 1 wherein each of the first and second trimmer arms has a proximal arm end and a distal arm end and a corresponding one of the first trimmer jaw and the second trimmer jaw is carried by the distal arm end.

3. The wick trimmer of claim 2 further comprising an arm connecting portion connecting the first and second trimmer arms at the proximal arm end of each.

4. The wick trimmer of claim 3 wherein the first and second trimmer arms diverge from the proximal arm end to the distal arm end of each.

5. The wick trimmer of claim 1 wherein each of the first blade notch and the second blade notch is generally V-shaped.

6. The wick trimmer of claim 5 wherein each of the first blade notch and the second blade notch comprises a pair of angled blade edges and the first wick groove is at a junction between the blade edges of the first blade notch and the second wick groove is at a junction between the blade edges of the second blade notch.

7. The wick trimmer of claim 1 wherein the second wick trimmer jaw is sized to receive and accommodate the first wick trimmer jaw in the closed, wick-cutting position.

8. The wick trimmer of claim 1 wherein each of the first wick trimmer jaw and the second wick trimmer jaw has a generally C-shaped cross-section.

9. A wick trimmer, comprising:

a pair of connected first and second trimmer arms;

a first wick trimmer jaw carried by the first trimmer arm and having a first jaw interior of selected volume;

a second wick trimmer jaw carried by the second trimmer arm and having a second jaw interior, the first and second wick trimmer jaws selectively positional between an open position and a closed, wick cutting position;

the volume of the first wick trimmer jaw is larger than a size of the second wick trimmer jaw and adapted to receive and contain the second wick trimmer jaw in the closed, wick cutting position;

a first wick cutting blade carried by the first wick trimmer jaw and having a first blade notch and a first wick groove in a center of the first blade notch;

a second wick cutting blade carried by the second wick trimmer jaw and having a second blade notch and a second wick groove in a center of the second blade notch, the second blade notch generally symmetrical to the first blade notch and the second wick groove in the second blade notch disposed in generally facing and offset relationship to the first wick groove in the first blade notch in the open position of the first and second wick trimmer jaws;

the second wick groove in the second blade notch bypasses the first wick groove in the first blade notch as the first wick trimmer jaw and the second wick trimmer jaw move from the open position to the closed, wick cutting position;

each of the first wick trimmer jaw and the second wick trimmer jaw includes a pair of generally rectangular, planar, parallel, spaced-apart side jaw panels and a generally rectangular, flat or planar outer jaw panel extending between the side jaw panels, the outer jaw panel disposed in generally perpendicular relationship to the wick cutting blade and each of the side jaw panels; and the second wick trimmer jaw substantially contained within the first jaw interior of the first wick trimmer jaw and the side jaw panels of the second wick trimmer jaw engage the outer jaw panel of the first wick trimmer jaw in the closed, wick cutting position.

10. The wick trimmer of claim 9 wherein each of the first and second trimmer arms has a proximal arm end and a distal arm end and a corresponding one of the first trimmer jaw and the second trimmer jaw is carried by the distal arm end.

11. The wick trimmer of claim 10 further comprising an arm connecting portion connecting the first and second trimmer arms at the proximal arm end of each.

12. The wick trimmer of claim 11 wherein the first and second trimmer arms diverge from the proximal arm end to the distal arm end of each.

13. The wick trimmer of claim 9 wherein each of the first blade notch and the second blade notch is generally V-shaped.

14. The wick trimmer of claim 13 wherein each of the first blade notch and the second blade notch comprises a pair of angled blade edges and the first wick groove is at a junction between the blade edges of the first blade notch and the second wick groove is at a junction between the blade edges of the second blade notch.

15. The wick trimmer of claim 9 wherein each of the first wick trimmer jaw and the second wick trimmer jaw has a generally C-shaped cross-section.

16. A wick trimmer, comprising:

a pair of generally elongated first and second trimmer arms each having a proximal arm end and a distal arm end;

an arm connecting portion connecting the first and second trimmer arms generally at the proximal arm end of each;

a first wick trimmer jaw carried by the distal arm end of the first trimmer arm, the first wick trimmer jaw having a first jaw width, a first jaw depth and a first jaw interior of selected volume;

a second wick trimmer jaw carried by the distal arm end of the second trimmer arm and having a second jaw interior, the first and second wick trimmer jaws selectively positional between an open position and a closed, wick cutting position;

the second wick trimmer jaw having a second jaw width and a second jaw depth less than the first jaw width and the first jaw depth of the first wick trimmer jaw, whereby the volume of the first wick trimmer jaw is larger than a size of the second wick trimmer jaw and is adapted to receive and contain the second wick trimmer jaw in the closed, wick cutting position;

a first wick cutting blade having a first blade notch carried by the first wick trimmer jaw at a distal end of the first jaw interior and a first wick groove in a center of the first blade notch;

a second wick cutting blade having a second blade notch carried by the second wick trimmer jaw at a distal end of the second jaw interior and a second wick groove in a center of the second blade notch, the second blade notch generally symmetrical to the first blade notch and the second wick groove in the second blade notch disposed in generally facing and offset relationship to the first wick groove in the first blade notch in the open position of the first and second wick trimmer jaws;

the second wick groove in the second blade notch bypasses the first wick groove in the first blade notch as the second wick cutting blade inserts into the first jaw interior of the first wick trimmer jaw during movement of the first wick trimmer jaw and the second wick trimmer jaw from the open position to the closed, wick-cutting position;

each of the first wick trimmer jaw and the second wick trimmer jaw includes a pair of generally rectangular, planar, parallel, spaced-apart side jaw panels and a generally rectangular, flat or planar outer jaw panel extending between the side jaw panels, the outer jaw panel disposed in generally perpendicular relationship to the wick cutting blade and each of the side jaw panels; and the second wick trimmer jaw substantially contained within the first jaw interior of the first wick trimmer jaw and the side jaw panels of the second wick trimmer jaw engage the outer jaw panel of the first wick trimmer jaw in the closed, wick cutting position.

17. The wick trimmer of claim 16 wherein the first and second trimmer arms diverge from the proximal arm end to the distal arm end of each.

18. The wick trimmer of claim 16 wherein each of the first blade notch and the second blade notch is generally V-shaped.

19. The wick trimmer of claim 18 wherein each of the first blade notch and the second blade notch comprises a pair of angled blade edges and the first wick groove is at a junction between the blade edges of the first blade notch and the second wick groove is at a junction between the blade edges of the second blade notch.

20. The wick trimmer of claim 17 wherein each of the first wick trimmer jaw and the second wick trimmer jaw has a generally C-shaped cross-section.

* * * * *